US006102040A

United States Patent [19]

Tayebi et al.

[11] Patent Number: 6,102,040

[45] **Date of Patent: *Aug. 15, 2000**

[54] BREATHING MASK

[76] Inventors: Amad Tayebi, 5 Sequoia Rd., Westford; Ashish K. Mithal, 8 Hatikva Way, North Chelmsford; George S. Saati, 1221 Pawtucket Blvd., No. 80, Lowell, all of Mass. 01854; Scott W. Cormier, 4 Bradford St., Windham, N.H. 03087

[ * ] Notice: This patent is subject to a terminal disclaimer.

[21] Appl. No.: 08/946,737

[22] Filed: Oct. 6, 1997

Related U.S. Application Data

[63] Continuation of application No. 08/623,853, Mar. 26, 1996, Pat. No. 5,673,690.

[51] Int. Cl.[7] ..... A62B 7/10

[52] U.S. Cl. ..... 128/206.24; 128/205.27; 128/205.29; 128/206.19; 128/206.23

[58] Field of Search ..... 128/205.29, 206.13, 128/206.16, 206.17, 206.21, 206.26, 206.28, 207.11, 206.24

[56] References Cited

U.S. PATENT DOCUMENTS

| | | | |
|---|---|---|---|
| 4,296,746 | 10/1981 | Mason, Jr. . | |
| 4,454,881 | 6/1984 | Huber et al. | 128/206.15 |
| 4,739,755 | 4/1988 | White et al. | 128/206.12 |
| 4,827,924 | 5/1989 | Japuntich | 128/206.12 |
| 4,873,972 | 10/1989 | Magidson et al. | 128/206.12 |
| 4,951,664 | 8/1990 | Niemeyer | 128/206.24 |
| 5,429,318 | 7/1995 | Tayebi . | |
| 5,673,690 | 10/1997 | Tayebi et al. | 128/206.24 |

FOREIGN PATENT DOCUMENTS

| | | |
|---|---|---|
| 526 050 | 7/1956 | Belgium . |
| 0 264 772 | 4/1988 | European Pat. Off. . |
| 2 166 558 | 8/1973 | France . |
| 30 32 437 | 3/1982 | Germany . |

OTHER PUBLICATIONS

PCT International Search Report for PCT/US97/04838 Applicant: Better Breathing, Inc.
Search Report Date of Mailing: Jul. 28, 1997.

*Primary Examiner*—Robert A. Clarke
*Assistant Examiner*—Joseph F. Weiss, Jr.

[57] ABSTRACT

The present invention provides different size breathing masks in which single size filtration shells are attached to a single size face contacting member at the same periphery. A single size face contacting member has one, or more than one size, inner breathing opening with a narrower cut profile in the nose area than in the mouth and chin area. Such different size breathing masks would fit and provide an effective seal for more than one size of wearer.

20 Claims, 8 Drawing Sheets

BREATHING MASK

RELATED APPLICATIONS

This is a continuation of U.S. Ser. No. 08/623,853 filed Mar. 26, 1996 entitled "Breathing Mask", now U.S. Pat. No. 5,673,690.

FIELD OF THE INVENTION

The present invention relates to breathing masks used for wearer protection from contaminants in hazardous environments. In particular, it provides a low cost, size-determining facepiece liner for masks. The facepiece liner of the present invention makes it possible to combine single size filtration shells with a variety of soft, flexible facepiece liners having distinctly different shaped breathing openings in order to obtain face masks that fit and provide an effective seal for more than one wearer's face size.

BACKGROUND OF THE INVENTION

In U.S. Pat. No. 5,419,318, a breathing mask is disclosed which features a soft, flexible face contacting member and outer filtration shell member fastened thereto to form a mask. The face contacting member is three-dimensionally formed in an arcuate shape that provides a cup in which the chin of the mask wearer rests in order to prevent the mask from slipping under the chin of the wearer. The outer shell member is either an air permeable filtration material or may be a rigid air impervious material through which air filtration element(s) are mounted to filter breathed air. U.S. Pat. No. 5,419,318 enables one to manufacture face masks that fit and provide an effective seal for more than one wearer's size by combining single size filtration shells with more than one size soft, flexible face contacting members, formed in more than one size arcuate shapes, featuring more than one size chin cups, having more than one size inner breathing openings and fastened to the single size filtration shells at the same outer periphery.

As shown in FIG. 1, face mask 100, placed on small size wearer's face 101*a* (shown in solid line), combines filtration shell 102 with small size face contacting member 103*a*, formed in small size arcuate shape 104*a* and having small size chin cup 105*a* and small size inner breathing opening 106*a*. Small size face contacting member 103*a* and filtration shell 102 are fastened to each other at outer periphery 107. Also, as shown in FIG. 1, face mask 100, placed on large size wearer's face 101*b* (shown in dashed line) combines same size filtration shell 102 with large size face contacting member 103*b*, formed in large size arcuate shape 104-*b* and having large size chin cup 105-*b* and large size inner breathing opening 106*b*. Large size face contacting member 103*b* and same size filtration shell 102 are fastened to each other at same outer periphery 107.

Another known mask, manufactured by Minnesota Mining and Manufacturing Company of St. Paul, Minn. (Style No. 9970), features, as shown in FIGS. 2 and 2B, a single size filtration shell 202 attached to soft flexible planar face contacting member 203. In various sizes of face mask 200, planar face contacting member 203 appears to have approximately the same size inner breathing opening 206 and appears to be fastened to filtration shell 202 at approximately the same outer periphery 207. It is important and relevant to the present invention to also point out that inner breathing opening 206 is of an elliptical shape and is symmetric around axes X-X and Y-Y. As such, in order to conform face contacting member 203 to the shape of a wearer's face, a deformable strip (nose clip) 208 is attached onto filtration shell 202. Deformable strip 208 is shaped by the wearer to fit around his/her nose bridge in order to provide a seal. Mask 200 also features exhalation valve 209 and head band length adjustment brackets 210.

A third known mask, manufactured by Racal Health and Safety, Inc., Frederick of Maryland (Style No. Delta 3), features, as shown in FIGS. 3 and 3A, a filtration shell 302 attached to soft, flexible face contacting member 303. In various sizes of mask 300, various sizes of filtration shell 302 are attached to various sizes of soft, flexible face contacting member 303, having more than one size inner breathing opening 306, at distinctly different size outer peripheries 307. Again, it is important and relevant to the present invention to point out that inner breathing opening 306 is of a race track shape and is symmetric around axes X-X and Y-Y. As such and likewise, in order to conform face contacting member 303 to shape of wearer's face, a deformable nose clip 308 is attached to filtration shell 302 and shaped as described above. Mask 300 also features an exhalation valve 309.

Examination of the latter masks reveals a number of limitations, disadvantages and/or design inconsistencies, including: (1) producing a specific shape/size arcuate shape face contacting member for each wearer's size is costly; (2) producing a specific size filtration shell and a specific size face contacting member for each wearer's size is not only costly but also results in a higher breathing resistance and lower filtration efficiency in small size masks due to the smaller filtration area in small size masks; (3) attaching a single size filtration shell to face contacting members, having approximately the same size inner breathing opening at approximately the same outer periphery, yields masks of nominally different sizes but actually poor fit characteristics. Such poor fit was the subject of a report published by Dr. Helson Leidel, formerly associated with the National Institute for Occupational Safety and Health (NIOSH) in 1994; and (4) using an inner breathing opening with symmetry about axis X-X (as shown in FIGS. 2 and 3) is inconsistent with how the facial nose area is inherently smaller and of narrower width than the mouth and chin area.

The present invention overcomes the limitations, disadvantages and design inconsistencies of these known masks by providing different size face masks in which a single size filtration shell is attached to a single size face contacting member at the same periphery, wherein the single size face contacting member has one, of more than one size, inner breathing opening with a narrower cut profile in the nose area than in the mouth and chin area. Such different size face masks would fit and provide an effective seal for more than one size of wearer. A face mask that provides the above features would not only eliminate all of the above-mentioned limitations, disadvantages and design inconsistencies, but also have significant cost, manufacturing, and inventory control advantages.

The present invention also provides a face mask which, in addition to eliminating slippage relative to the wearer's face by deforming the flexible face liner to form a chin cup and providing an effective seal to the wearer's face, has no contact between the wearer's face and the filtration shell thereby ensuring a maximum area for flow of filtered air and, therefore, a minimum breathing resistance regardless of the wearer's face size.

DESCRIPTION OF THE DRAWINGS

The present invention will be better understood upon reading the following detailed description in conjunction with the drawing in which.

DETAILED DESCRIPTION

In accordance with the present invention, the size-determining facepiece liner comprises a flexible face contacting member that has an inner breathing opening which is shaped to provide an aperture that has a narrow upper section and wide lower section in order to surround and accommodate the nose and mouth of the wearer. The wearer's nose bridge and sides fit through and are surrounded by the upper section. The wearer's mouth fits through and is surrounded by the lower section.

Figure 1:
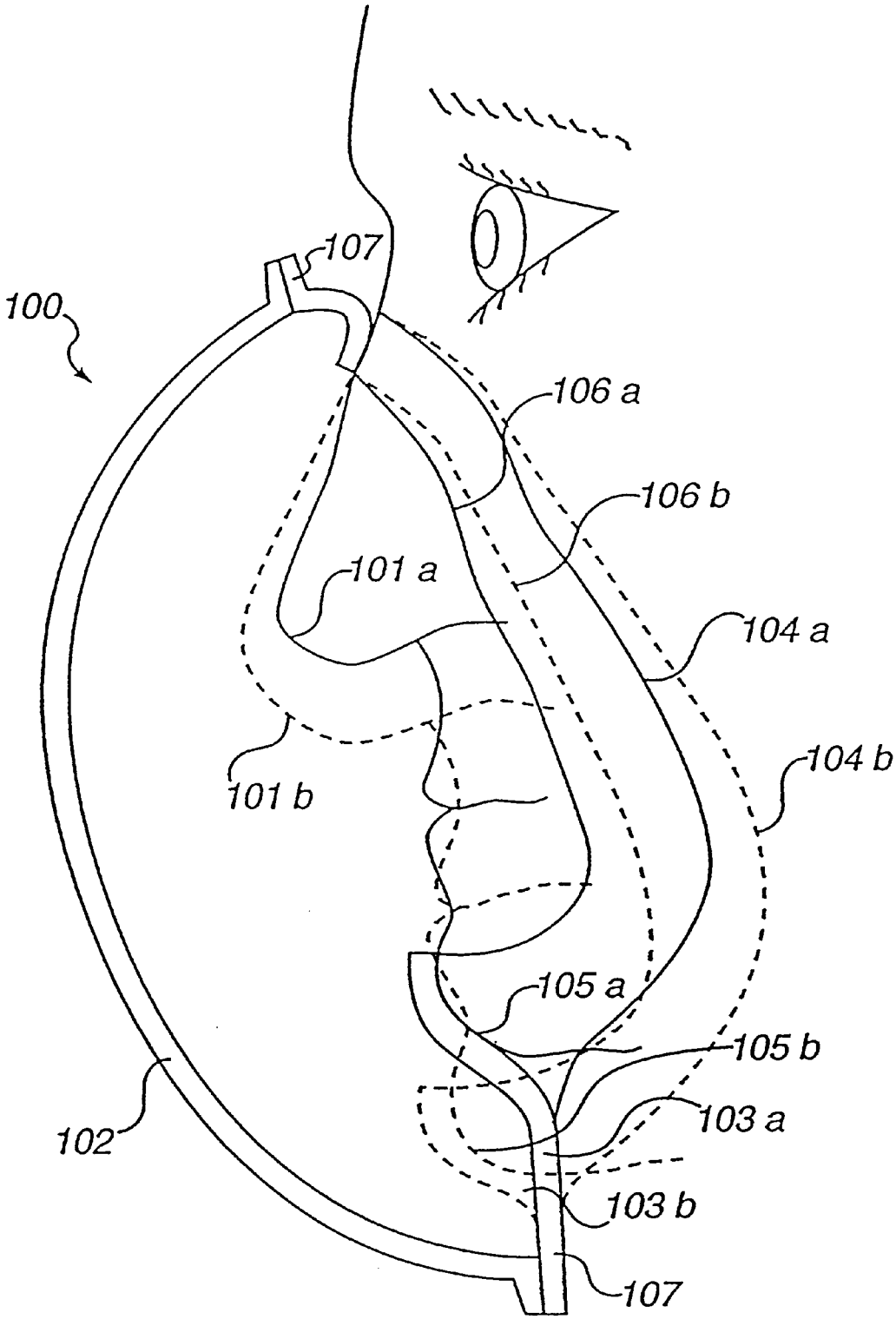
Figure 1 (Prior Art)
FIG. 1 is a side view of a prior art breathing mask.
Figure 2:
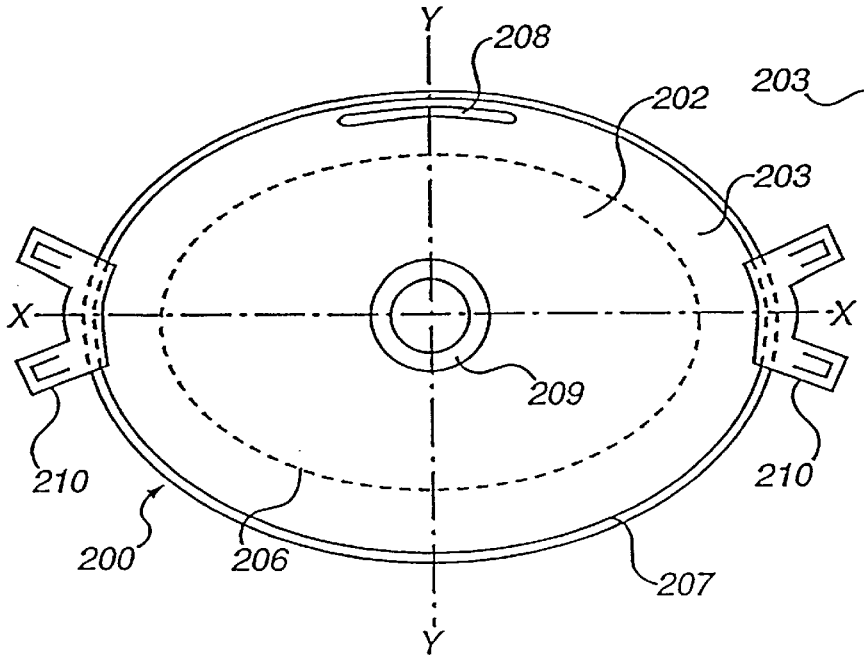
Figure 2 (Prior Art)
FIGS. 2 and 2B, respectively, are a front and side view of a prior art breathing mask.
Figure 2B:
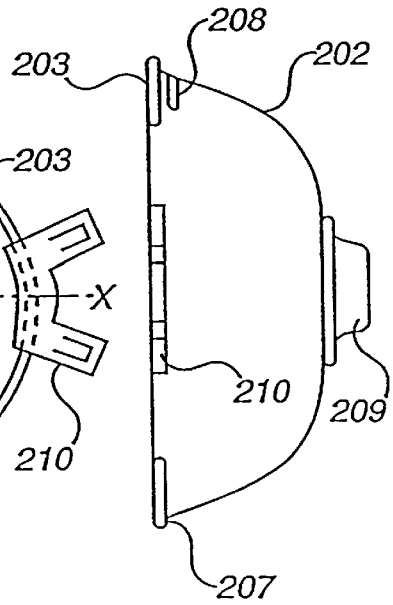
Figure 2B (Prior Art)
Figure 3:
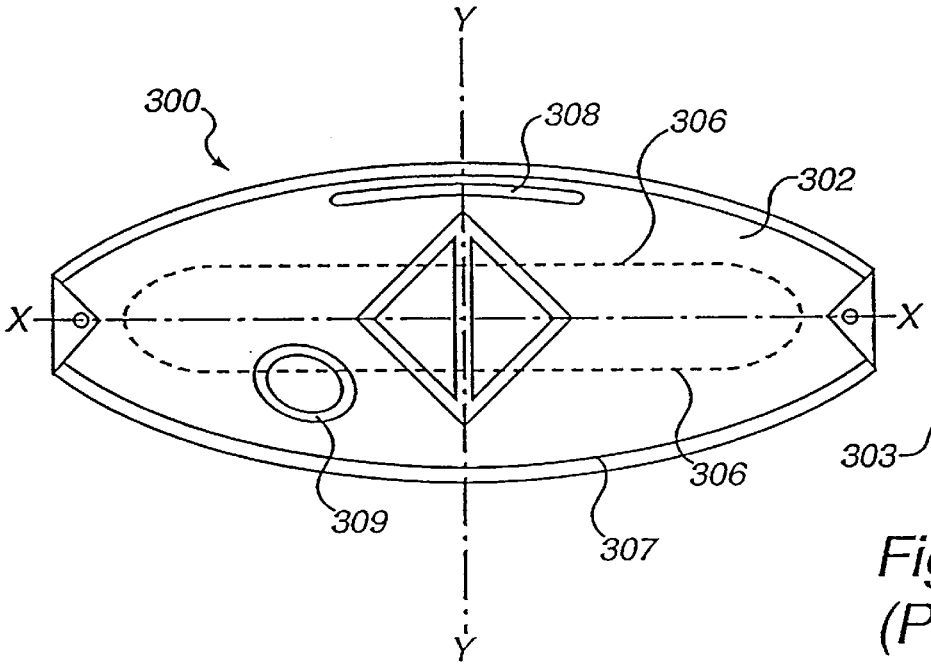
Figure 3 (Prior Art)
FIGS. 3 and 3B, respectively, are a front and side view of a prior art breathing mask.
Figure 3B:
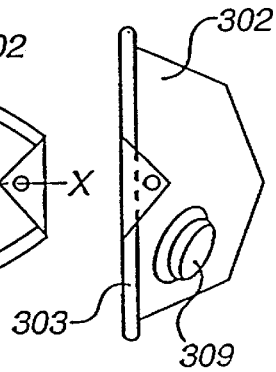
Figure 3B (Prior Art)
Figure 4:
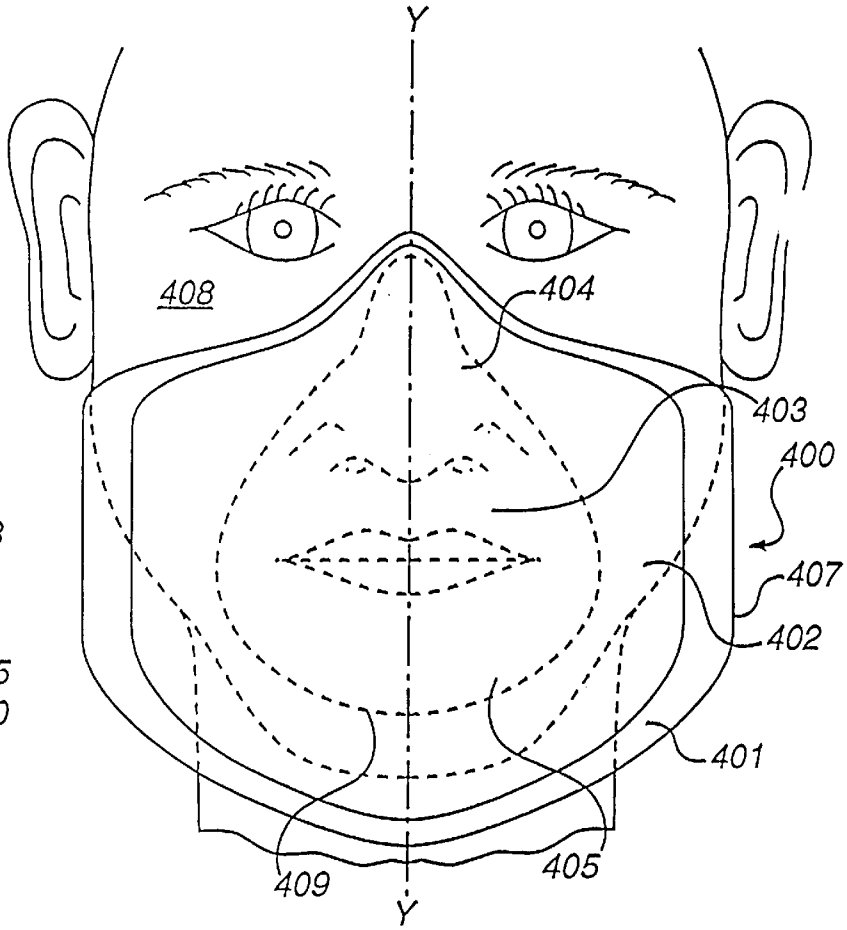
FIG. 4 is a front view of a breathing mask in accordance with the present invention.

As shown in FIG. 4, in its simplest form, the face contacting member 400 is made of flexible sheet material that has a periphery zone 401 surrounded by an outer edge profile 407, the periphery zone 401 surrounding a face contacting zone 402 and an inner breathing cut-out opening 403 located within face contacting zone 402. Opening 403 has a narrow upper section 404 and a wider lower section 405. Face contacting member 400 is placed on wearer's face 408 such that the inner edge profile 409 of inner breathing cut-out opening 403 surrounds the wearer's nose and mouth and provides an effective seal between face contacting zone 402 and wearer's face 408.

Figure 4A:
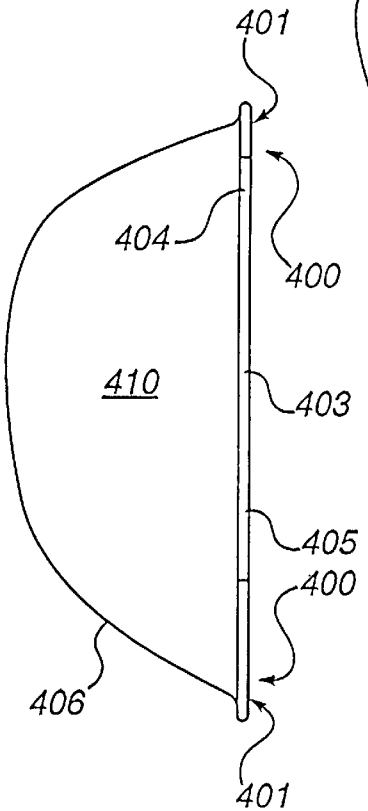
FIG. 4A is a side view of the breathing mask shown in FIG. 4.
Figure 4B:
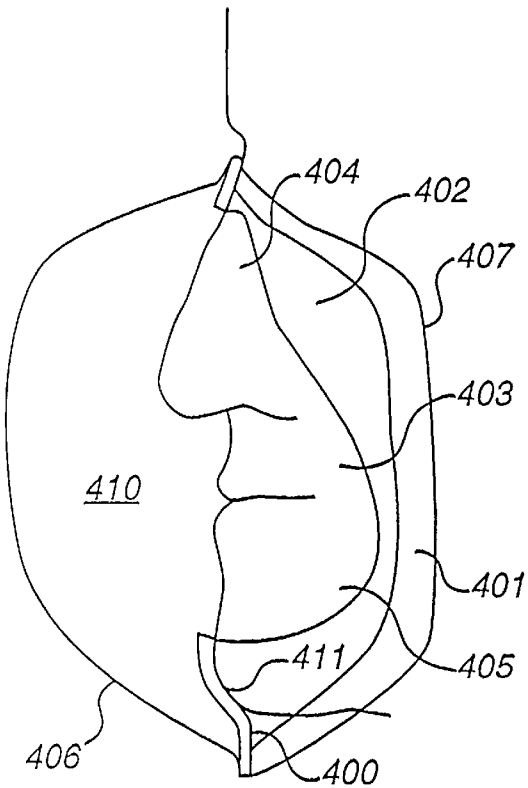
FIG. 4B is a side view of the breathing mask shown in FIG. 4 as mounted on a wearer's face.

A side view of face mask 410, assembled by attaching face contacting member 400 to filtration shell 406 at periphery zone 401 is shown in FIG. 4A. FIG. 4B shows face mask 410 when placed on a wearer's face. As shown therein, face contacting member 400 deforms in order to conform to and accommodate the wearer's nose and provide a chin cup 411 that conforms to and accommodates the wearer's chin and thereby provides an effective air-tight seal between face contacting zone 402 and the wearer's face.

In accordance with the present invention, filtration shell 406 may be made in a variety of shapes known in the art; for example, it may be of a three-dimensional, double curvature shape or of a folded or pleated shape. The folded surfaces and the pleats may be of a horizontal, vertical or any other orientation. Likewise, face contacting liner 400 may be of a substantially flat or of a folded shape in order to conform to the shape of filtration shell 406.

Figure 5:
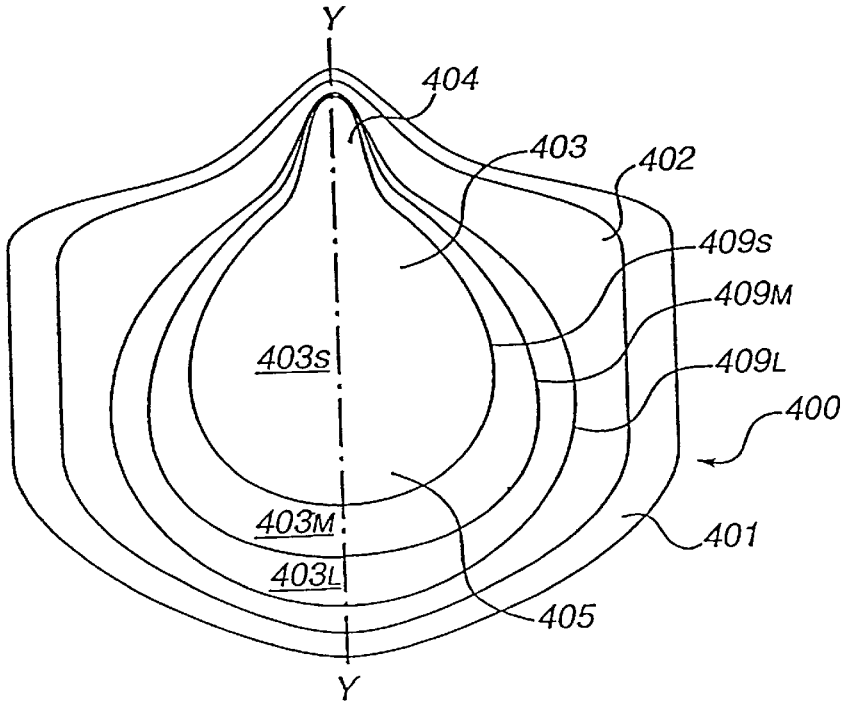
FIG. 5 is a front view of a size-determining facepiece liner of the present invention.

FIG. 5 shows a front view of a size-determining facepiece liner of the present invention wherein a single size face contacting member 400 has inner breathing opening 403S, 403M, 403L or any other size opening in order to make it possible to obtain face masks that fit and provide an effective seal for small, medium, large or any other wearer's face size, respectively, by attaching filtration shell 406 to face contacting member 400 at periphery zone 401. As shown therein, cut-out openings 403S, 403M and 403L are defined by inner edge profiles 409S, 409M and 409L, respectively.

Figure 6:
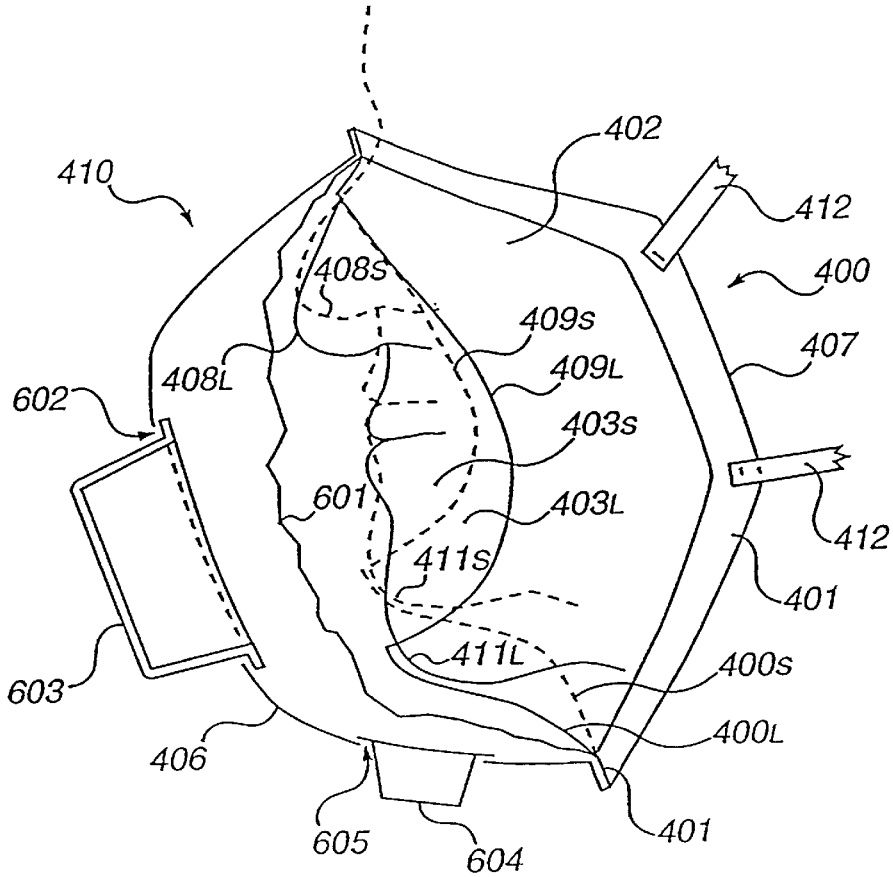
FIG. 6 shows a side cut-out superposed view of a small size mask as worn onto a small size wearer's face and a large size mask as worn onto a large size wearer's face in accordance with the present invention.

FIG. 6 shows a side cut-out superposed view of a small size breathing mask 410 comprised of filtration shell 406 attached to face contacting member 400S, having a small size inner breathing cut-out opening 403S defined by profile 409S (shown in dashed line), at periphery zone 401 as worn on a small size wearer's face 408S (shown in dashed line) and a large size breathing mask 410 comprised of same shell 406 attached to another face contacting member 400L, having a large size inner breathing cut-out opening 403L defined by profile 409L (shown in solid line), at the same periphery zone 401 as worn on a large size wearer's face 408L (shown in solid line). As shown therein, flexible face contacting members 400S and 400L deflect, deform and form small and large size chin cups in order to conform to and accommodate the nose and chin of small and large face contours 408S and 408L, respectively, and thereby provide an effective air-tight seal between face contacting zone 402 and more than one size wearer's face. Cut-out line 601 and filtration shell 406 are common to small and large size masks and all wearers' faces.

Filtration mask 410 may be securely mounted on the wearer's face by at least one headband 412 or by some other means known in the art. Formation of chin cups 411 and 411L also provides an effective seal with very low headband tension by providing a pivot point as taught in U.S. Pat. No. 5,419,318.

Filtration shell 406 may be made of an air permeable filtration material with a certain or desired filtration efficiency. In this respect, a variety of materials known in the art, or any combination of multi-layer laminates thereof, may be used. Alternatively, filtration shell 406 may be made of an air impervious material with at least one breathing opening 602 to which a filter element 603 is attached in order to filter all breathed air passing through breathing opening 602. In order to minimize the breathing resistance and maximize the filtration efficiency of mask 410, it is desirable to have face contacting zone 402 remain spaced apart from filtration shell 406, as shown in FIGS. 4B and 6.

A one-way exhalation valve 604 may be installed in another opening 605 in filtration shell 406, preferably near the bottom of shell 406, to exhaust exhaled air in a manner and construction known in the art. Filter element 603 and exhalation valve 604 are well known in the art and, therefore, are not described in further detail in this specification.

Face contacting member 400, which, in its simplest form, is generally planar, may be embossed, thermoformed, indented or shaped in the area around the nose, the wearer's cheeks and/or the chin in order to provide a more effective seal between its face contacting zone and the wearer's face. Face contacting member 400 may be made of soft, flexible, air-impermeable material, material combinations or multi-layer laminates, including elastomeric and closed cell foam materials, or alternatively from air permeable materials, preferably with filtration efficiency and characteristics consistent with the filtration efficiency and characteristics of filtration shell 406.

In accordance with the present invention, the inner breathing cut-out opening may be of a variety of shapes. Its inner edge profile may also be of an explicit or of an implicit nature without departing from the scope and spirit of the present invention. Regardless of its shape and the nature of its inner edge profile, the function performed by the inner breathing cut-out opening is always the same, namely providing an aperture that surrounds the nose and mouth of a wearer's face and thereby provides an effective, air-tight seal between face contacting zone 402 and a wearer's face 408.

Figure 7:
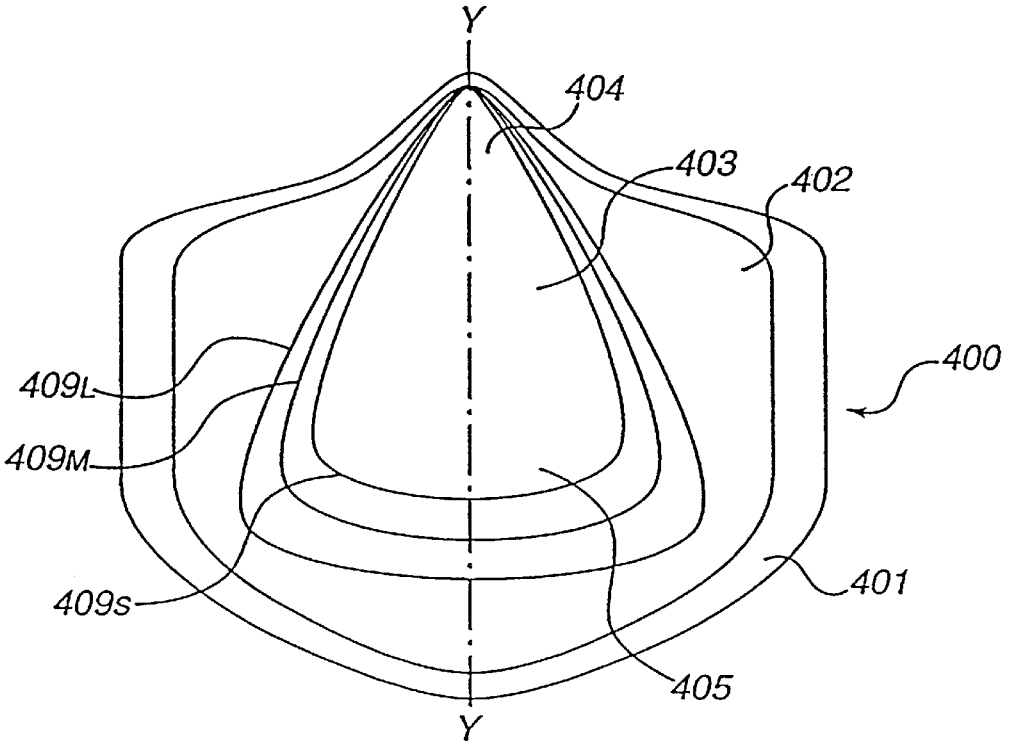
FIG. 7 is a front view of an alternative size-determining facepiece liner in accordance with the present invention.
Figure 8:
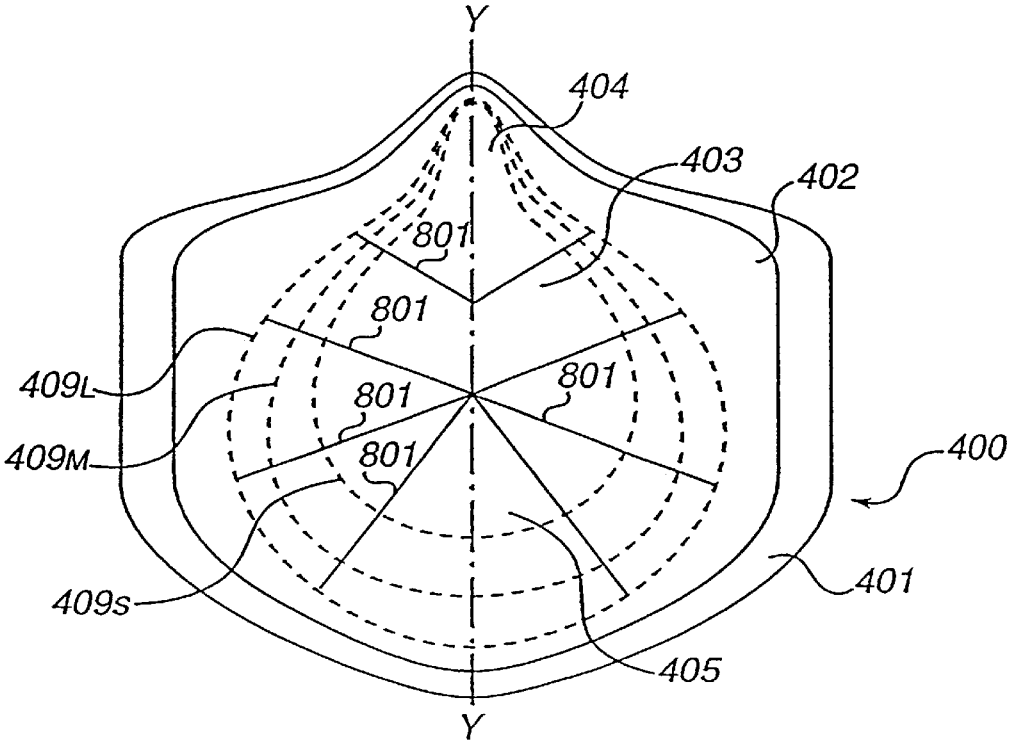
FIG. 8 is a front view of another alternative size-determining facepiece liner in accordance with the present invention.
Figure 9:
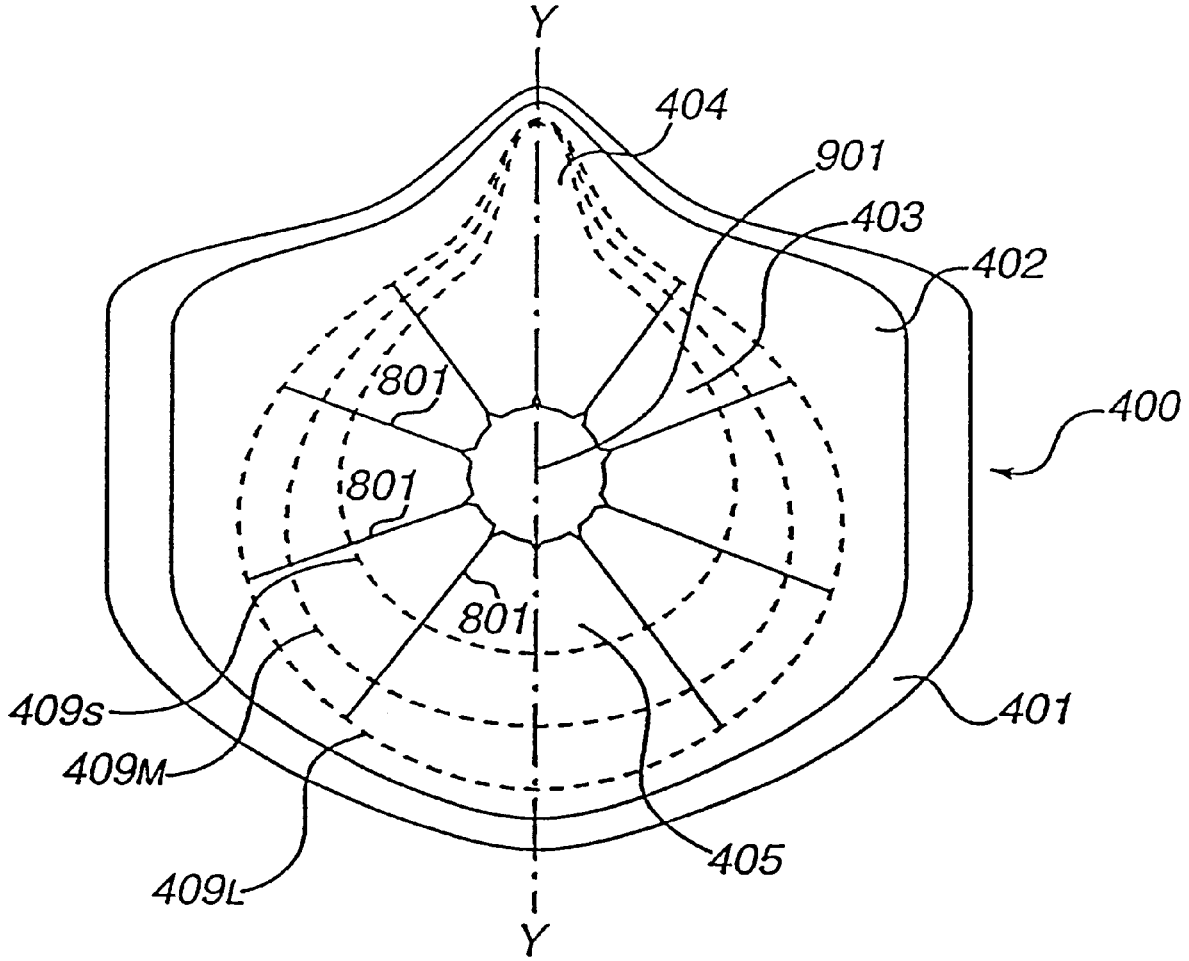
FIG. 9 is a front view of another alternative size-determining facepiece liner in accordance with the present invention.

Examples of an explicit inner edge profile 409 are shown in FIGS. 4 and 5. An additional example of explicit inner edge profile 409 is shown in FIG. 7. An example of implicit nature, inner edge profile 409 is shown in FIG. 8. As shown therein, depending on wearer's face size, slitting lines 801, which originate from the central zone of face contacting member 400, extend substantially radially up to imaginary inner edge profile lines 409S, 409M and 409L for small, medium and large wearers' face sizes. Slitting lines 801 create wedge-shape segments which, when pushed by wearer's face, deflect away into the inner space of filtration shell 406 and provide an implicit inner edge profile of the desired size. Combinations of cut-out holes and straight as well as curved slit lines may be utilized to make inner breathing cut-out openings of various sizes as shown in FIG. 9. As shown therein, a circular hole 901 is the origin zone of slitting lines 801 which, depending on the wearer's face size, extend radially to imaginary or printed/embossed inner edge profile lines 409S, 409M or 409L.

Alternatively, the inner breathing cut-out opening may be custom tailored and cut by the wearer to fit his/her own facial configuration. Printed or embossed lines on blank or small size inner breathing cut-out opening face contacting zone 402 may not only be used for guiding the wearer in custom tailoring the face contacting member to his/her exact facial configuration and size but also in converting the size of inner breathing cut-out opening to a larger size. These features, which are not currently available, are additional advantages of the present invention which also make it possible for the end user to carry few or even only one size mask in inventory while still meeting all size requirements, by custom tailoring the size of inner breathing cut-out opening to fit the particular wearer's face size. To help a wearer accomplish this, a variety of inner edge profile lines, for example 409S, 409M, 409L, may be imprinted or heavily embossed to act as tear-away impression lines that direct a tear line, started by the user, to follow a selected size inner breathing cut-out opening.

Figure 10A:
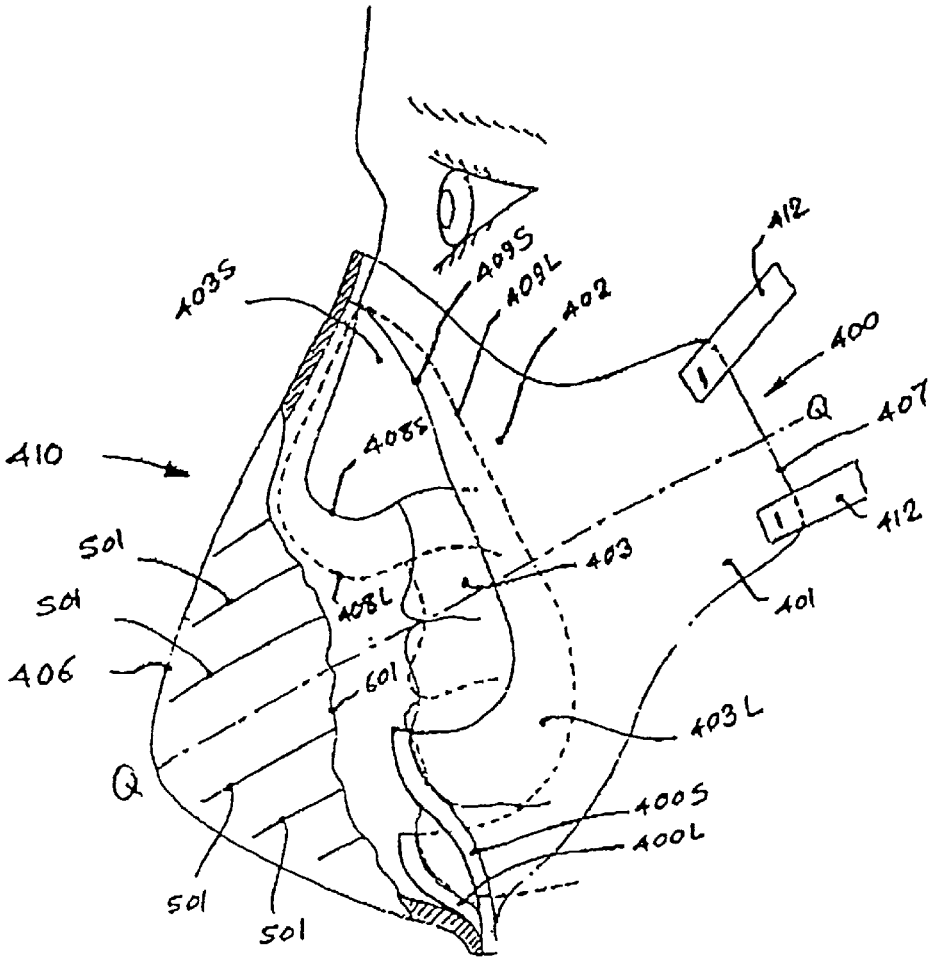
FIG. 10A shows a partial cut out view, along line 601, of an embodiment of breathing mask 410 wherein filtration shell 406 is of a horizontally foldable shape, around line Q—Q.
Figure 10B:
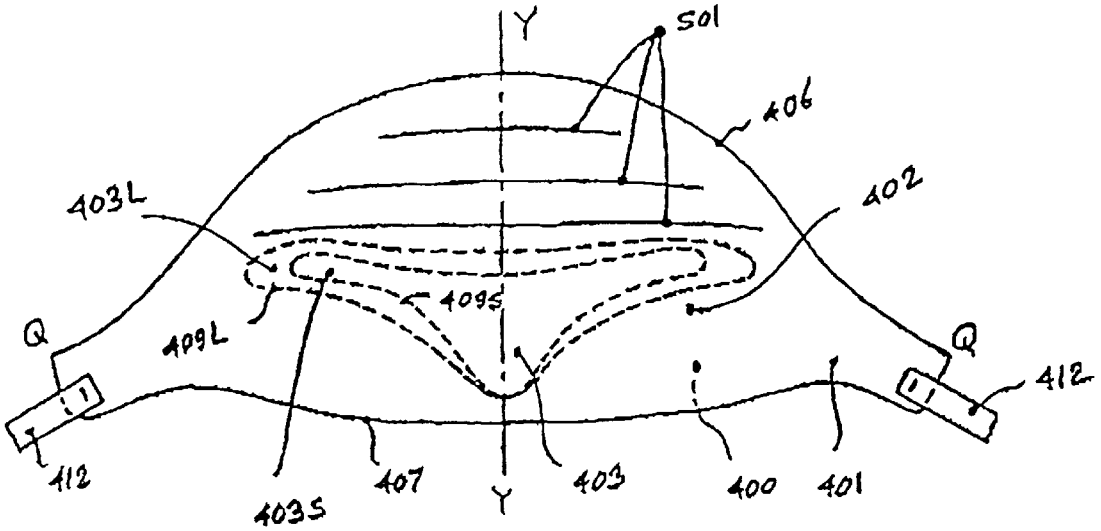
FIG. 10B shows a top view of breathing mask 410, shown in Figure 10A, in a horizontally folded configuration.
Figure 11:
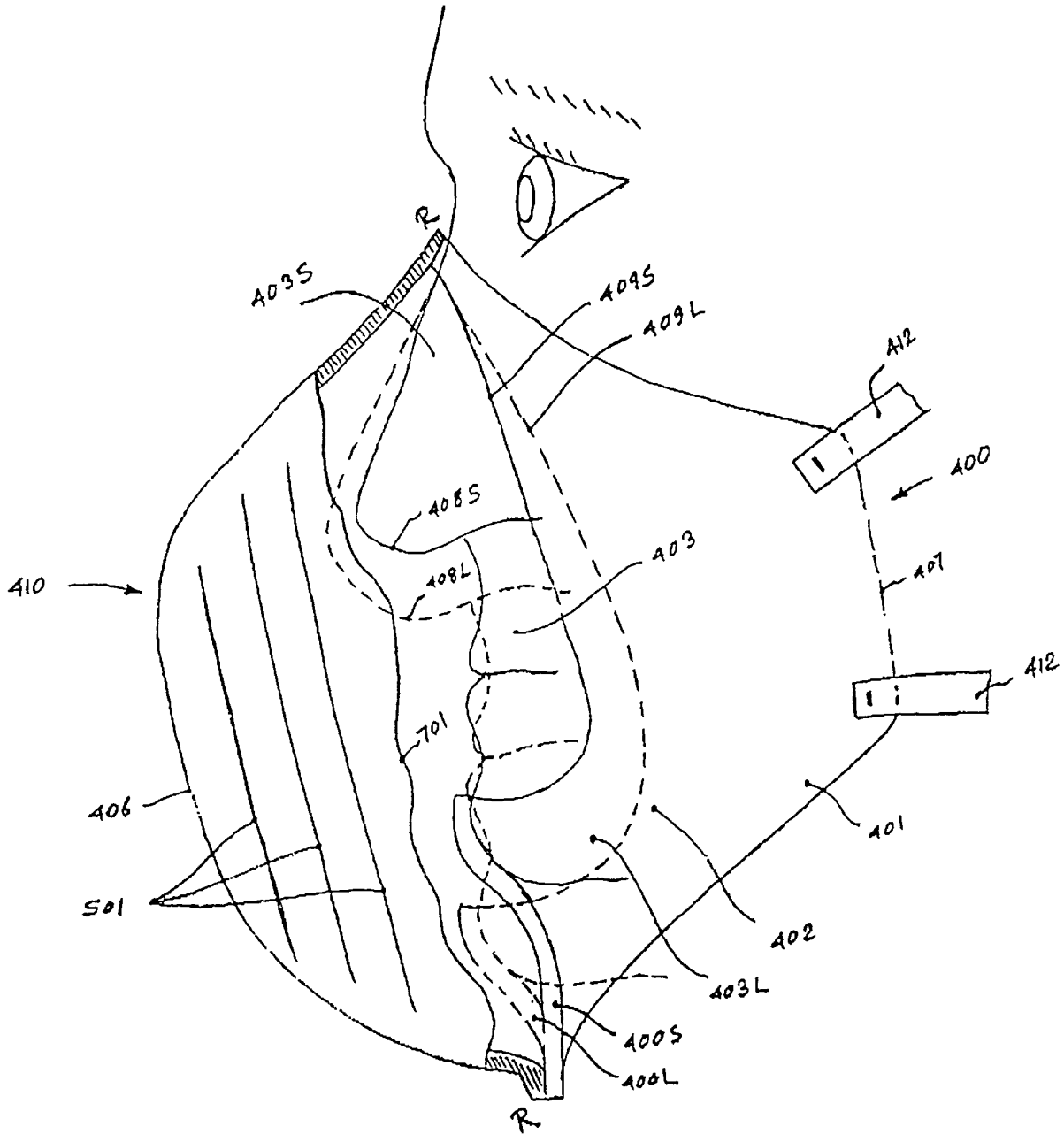
FIG. 11 shows a partial cut out view, along line 701, of an embodiment of breathing mask 410 wherein filtration shell 406 is of a vertically foldable shape, around line R—R.

As shown in FIGS. 10A, 10B and 11, the outer perimeter of face contacting member 400 is defined by outer edge profile 407 and comprises periphery zone 401, face contacting zone 402 and inner breathing cut-out openings 403S and 403L which are defined by inner edge profile 409S for small size wearer's face and 409L for large size wearer's face, respectively. Face contacting liners 400S and 400L deflect, deform and conform to the shape of wearer's face profile and chin for small size wearer's face 408S and large size wearer's face 408L, respectively. Filtration shell 406 is sealed to face contacting member 400 at periphery zone 401 so that all breathed air is filtered as it passes through filtration shell 406. Filtration shell 406 may be made of a filtration sheet material or of an impermeable material and fitted, through at least one opening, with a filtration element such as a filtration cartridge or liner.

Filtration shell 406 may also be configured so that it includes pleats or folds 501. Pleats or folds 501 may be of a horizontal orientation as shown in FIG. 10A, a vertical orientation as shown in FIG. 11 or any other orientation. In addition to their stiffness-enhancing and decorative effects, pleats 501 also increase the effective area of filtration shell 406 thereby decreasing the resistance to breathing and enhancing the filtration efficiency of filtration shell 406.

While what has been described hereinabove is a variety of embodiments of the invention, it will be obvious to those skilled in the art that numerous changes may be made without departing from the scope and spirit of the invention.

What is claimed is:

1. A one-size-fits-all breathing mask for filtering air breathed by a wearer using the mask, the breathing mask comprising: a face contacting liner, the face contacting liner being made of flexible material and having a periphery zone and a face contacting zone, the face contacting zone being surrounded by the periphery zone and having an adjustable inner breathing opening, the inner breathing opening being symmetric around a vertical axis and comprising an upper section and a lower section, the upper section being smaller than the lower section, the adjustable inner breathing opening providing an effective seal between the face contacting zone and face of the wearer, the face contacting liner being attached to a filtration shell through which breathed air passes, the filtration shell having a periphery zone, the periphery zone of the face contacting liner being attached to the periphery zone of the filtration shell such that the two periphery zones are substantially coextensive.

2. The breathing mask as described in claim 1 wherein the filtration shell is foldable.

3. The breathing mask as described in claim 2 wherein the filtration shell is horizontally foldable.

4. The breathing mask as described in claim 2 wherein the filtration shell is vertically foldable.

5. The breathing mask as described in claim 1 wherein the filtration shell includes pleats.

6. The breathing mask as described in claim 5 wherein the pleats are horizontal.

7. The breathing mask as described in claim 5 wherein the pleats are vertical.

8. The breathing mask as described in claim 1 wherein the filtration shell is a three-dimensional, double curvature shape.

9. The breathing mask as described in claim 1 wherein the filtration shell comprises a plurality of layers of filter media.

10. The breathing mask as described in claim 1 wherein the filtration shell comprises an air impervious material and at least one breathing opening to which a filter element is attached.

11. A one-size-fits-all breathing mask for filtering air breathed by a wearer using the mask, the breathing mask comprising: a face contacting liner, the face contacting liner being made of flexible material and having a periphery zone and a generally planar face contacting zone, the face contacting zone being surrounded by the periphery zone and having an inner adjustable breathing opening, the inner breathing opening comprising an upper section and a lower section, the upper section being smaller than the lower section, the adjustable inner breathing opening providing an effective seal between the face contacting zone and face of the wearer, the face contacting liner being attached to a filtration shell, the filtration shell having a periphery zone, the periphery zone of the face contacting liner being attached to the periphery zone of the filtration shell such that the two periphery zones are substantially coextensive.

12. The breathing mask as described in claim 11 wherein the filtration shell is foldable.

13. The breathing mask as described in claim 12 wherein the filtration shell is horizontally foldable.

14. The breathing mask as described in claim 12 wherein the filtration shell is vertically foldable.

15. The breathing mask as described in claim 11 wherein the filtration shell includes pleats.

16. The breathing mask as described in claim 15 wherein the pleats are horizontal.

17. The breathing mask as described in claim 15 wherein the pleats are vertical.

18. The breathing mask as described in claim 11 wherein the filtration shell is a three-dimensional, double curvature shape.

19. The breathing mask as described in claim 11 wherein the filtration shell comprises a plurality of layers of filter media.

20. The breathing mask as described in claim 11 wherein the filtration shell comprises an air impervious material and at least one breathing opening to which a filter element is attached.

* * * * *